United States Patent [19]

Iio

[11] Patent Number: 4,815,953

[45] Date of Patent: Mar. 28, 1989

[54] SEIZURE-FREE VANE ROTARY COMPRESSOR WITH VANES, ROTOR AND SIDE BLOCKS MADE OF SI-AL ALLOY MATERIAL

[75] Inventor: Masahiro Iio, Konan, Japan

[73] Assignee: Diesel Kiki Co., Ltd., Tokyo, Japan

[21] Appl. No.: 83,677

[22] Filed: Aug. 7, 1987

[30] Foreign Application Priority Data

Aug. 8, 1986 [JP] Japan ..... 61-187083
Aug. 8, 1986 [JP] Japan ..... 61-187084

[51] Int. Cl.[4] ..... F04C 29/00; F04C 18/344
[52] U.S. Cl. ..... 418/179
[58] Field of Search ..... 418/178, 259, 179; 29/156.4 R; 384/912

[56] References Cited

U.S. PATENT DOCUMENTS 1,087,962 2/1914 Matchette ..... 418/179
4,464,101 8/1984 Shibuya ..... 418/179

FOREIGN PATENT DOCUMENTS 25501 2/1979 Japan ..... 418/179
67989 4/1983 Japan ..... 418/179
22089 2/1985 Japan ..... 418/179
145480 7/1985 Japan ..... 418/179
89991 8/1986 Japan .

*Primary Examiner*—John J. Vrablik
*Assistant Examiner*—Leonard P. Walnoha
*Attorney, Agent, or Firm*—Koda and Androlia

[57] ABSTRACT

A vane rotary compressor wherein at least the rotor, side blocks and vanes are formed from Si-Al alloy materials, respectively, the rotor and the side blocks or the rotor and the vanes differ from each other by more than 3% in terms of their silicon content. Thus, the compressor has improved wear resistance, seizure resistance, compression performance and durability.

2 Claims, 3 Drawing Sheets

SEIZURE-FREE VANE ROTARY COMPRESSOR WITH VANES, ROTOR AND SIDE BLOCKS MADE OF SI-AL ALLOY MATERIAL

BACKGROUND OF THE INVENTION

1. Field of the Invention:

The present invention relates to a vane rotary compressor with vanes, rotor and side blocks made of Si-Al alloy material. More particularly, the present invention pertains to a combination of materials for the rotor and side blocks of a vane rotary compressor or for the rotor and vanes thereof for the purpose of preventing the occurrence of wear and seizure at the area of sliding contact between the rotor and each of the side blocks and between the rotor and each of the vanes, and for the purpose of reducing the weights of these constituent members.

2. Description of the Related Art:

Vane rotary compressors are employed for various kinds of apparatus, e.g. air conditioners for vehicles wherein they are used in order to compress a refrigerant gas.

There has been a recent tendency to produce vane rotary compressors using light alloys in place of iron-based metals in order to reduce weight.

Examples of such vane rotary compressors include those which are disclosed in Japanese Patent Application Laid-Open Publication Nos. 61-89991 and 60-22089.

In the vane rotary compressor disclosed in Japanese Patent Application Laid-Open Publication No. 61-89991, an aluminum-based metal is employed to form components of the compressor, such as a cylinder block having a cylindrical sliding contact surface with an elliptical cross-section, a rotor rotatably accommodated within the cylinder block, and either one of the side blocks which are rigidly secured to two axial ends, respectively, of the cylinder block, for the purpose of reducing the overall weight of the compressor.

In the vane rotary compressor disclosed in Japanese Patent Application Laid-Open Publication No. 60-22089, the outer peripheral portion of the rotor including the vane grooves is covered with an aluminum-based metal containing silicon or the like in order to prevent the occurrence of wear in the areas of sliding contact between the vanes and the rotor and between the rotor and each of the side blocks and also to reduce the overall weight of the compressor.

However, the vane rotary compressors of the type described above suffer from inferior compression capacity and durability, though the employment of an aluminum-based metal makes possible a reduction in weight.

More specifically, since aluminum-based metals are basically inferior in terms of wear resistance and seizure resistance, the areas of sliding contact between each vane and the rotor and between the rotor and each side block readily become worn. Therefore, when the compressor is in an operative state, particularly when it is run under heavy load and at high rotational speed, back-pressure or refrigerant gas may leak out through the worn area, resulting in a lower compression capacity. In addition, occurrence of seizure at the sliding contact area makes it impossible to use the compressor.

Even if the hardness of an aluminum-based alloy is increased by adding silicon or the like thereto, it is difficult to completely overcome the above-described disadvantages when portions which are in sliding contact with each other are made from the same material.

SUMMARY OF THE INVENTION

In view of the above-described problems of the prior art, it is a primary object of the present invention to provide a vane rotary compressor which is produced using an aluminum-based material to reduce the overall weight, and yet which has improved wear resistance, seizure resistance, compression performance and durability.

To this end, the present invention provides a vane rotary compressor of the type wherein a refrigerant gas is drawn in, compressed and then discharged, characterized in that at least the rotor, side blocks and vanes are formed using Si-Al alloy materials, respectively, the Si-Al alloy materials for the rotor and the side blocks or the materials for the rotor and the vanes having silicon contents which differ from each other by more than 3% or more.

It is generally known that phenomena such as wear and seizure occur when two materials slide while rubbing against each other, and wear resistance and seizure resistance change in accordance with the combination of two materials which rub against each other. The inventor of the present invention examined various combinations of Si-Al alloy materials having different silicon contents on the basis of the Falex seizure test and has found that it is possible to improve the wear resistance and seizure resistance of the compressor by forming sliding portions using Si-Al alloy materials having silicon contents which differ from each other by more than 3% or more as in the case of the vane rotary compressor according to the present invention.

The above and other objects, features and advantages of the present invention will become clear from the following description of the preferred embodiment thereof, taken in conjuction with the accompanying drawings.

DESCRIPTION OF THE PREFERRED EMBODIMENT

Figure 1:
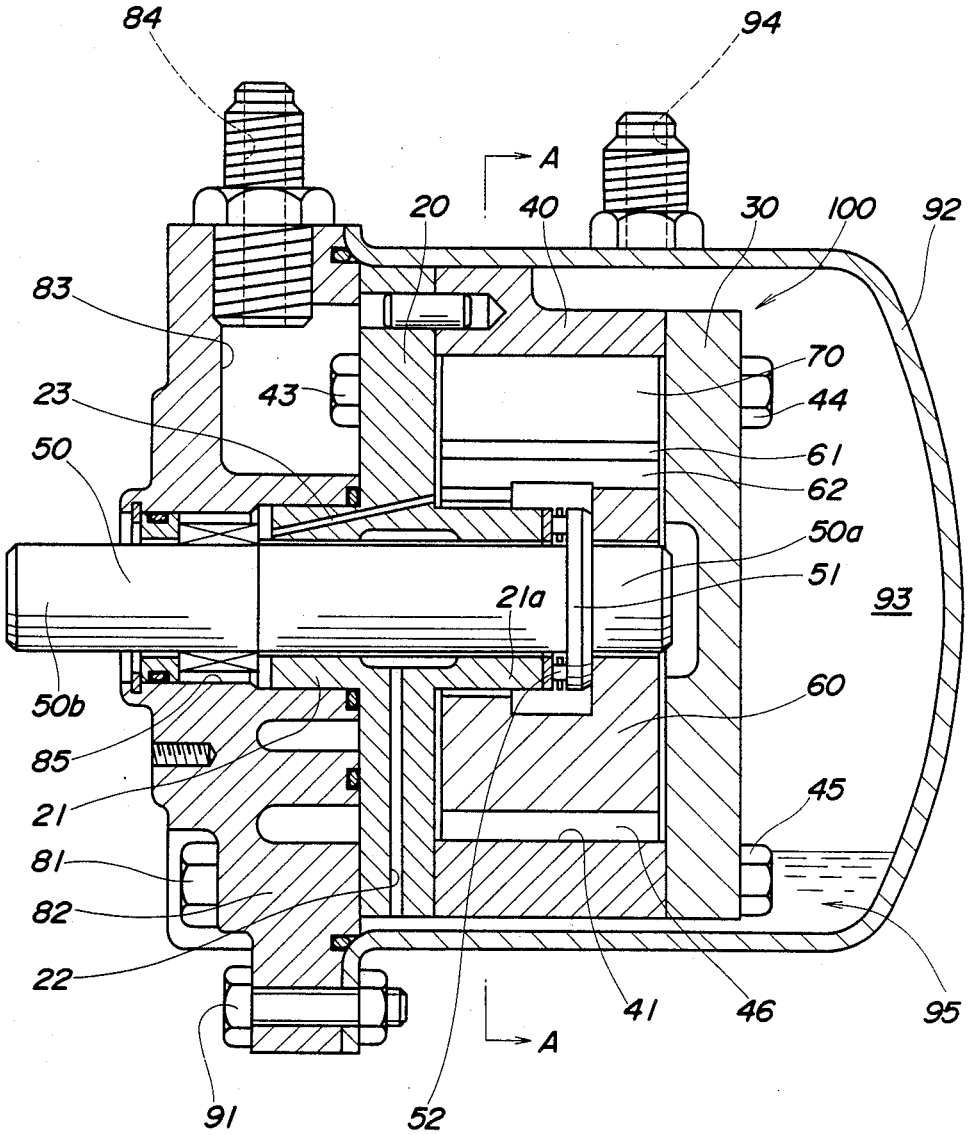
FIG. 1 is a longitudinal sectional view of one embodiment of the vane rotary compressor according to the present invention.
Figure 2:
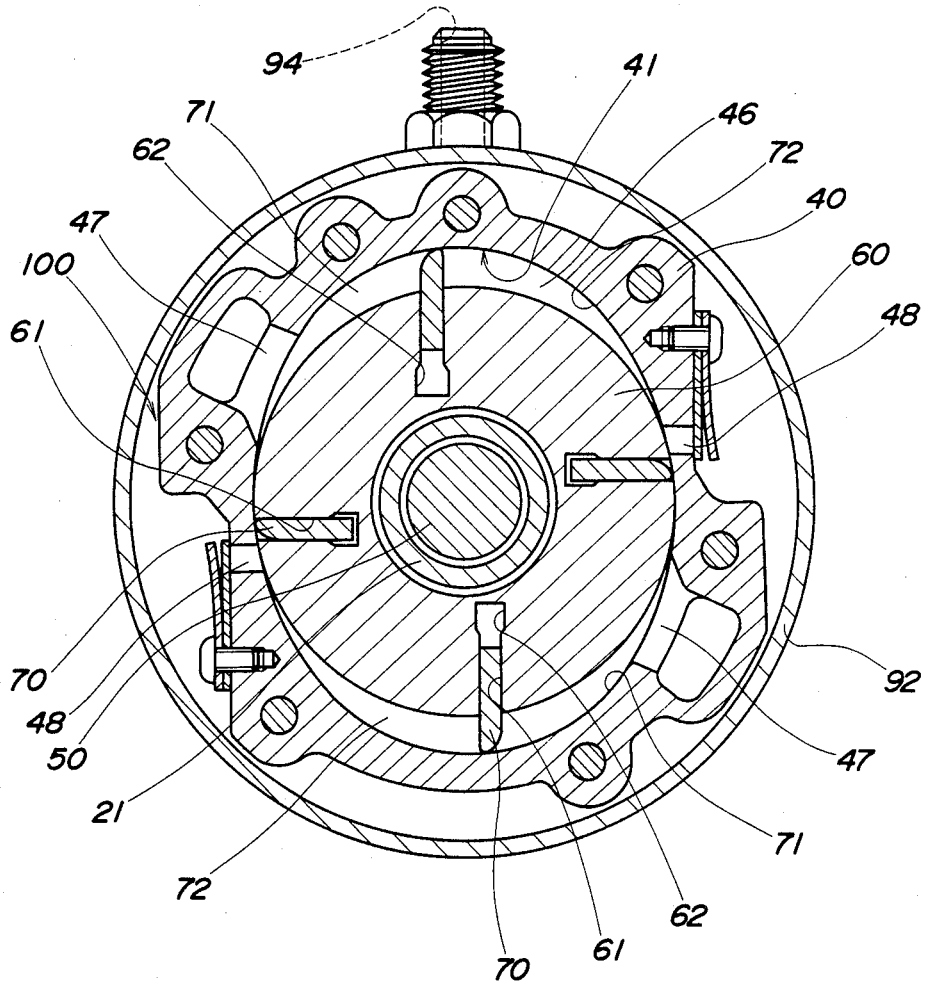
FIG. 2 is a sectional view taken along the line A—A of FIG. 1.
Figure 3:
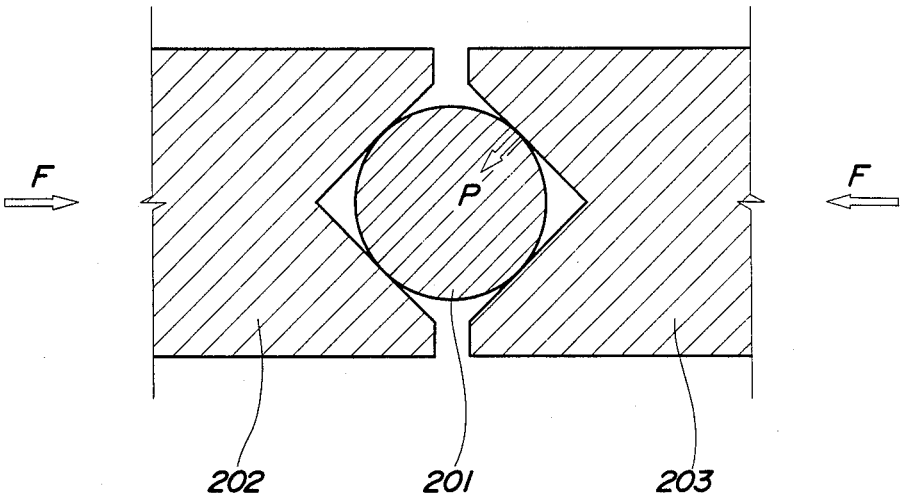
FIG. 3 is a sectional view employed to describe the Falex test.

Referring to FIGS. 1 to 3, which show in combination one preferred embodiment of the present invention, reference numeral 100 denotes a vane rotary compressor body.

The body 100 consists essentially of a front side block 20, a rear side block 30, a cylinder block 40, a drive shaft 50, a rotor 60 and vanes 70. The body 100 is covered with a head plate 82 and a casing 92. The head plate 82 is rigidly secured to the front side block 20 by means of a bolt 81, and the casing 92 is rigidly secured to the head plate 82 by means of a bolt 91.

As shown in FIG. 2, the cylinder block 40 has an elliptical cross-section and provides a sliding contact surface 41 defined by its inner peripheral surface. The cylinder block 40 is secured between the front and rear side blocks 20 and 30 by means of bolts 43, 44 and 45, so that a cylinder chamber 46 is defined between these three blocks.

The drive shaft 50 extends through a bearing portion 21 of the front side block 20 so as to be rotatably supported by the bearing portion 21. The bearing portion 21 is formed in the shape of a tube having a predetermined length. A thrust bearing 52 is interposed between one end 21*a* of the bearing portion 21 and a collar 51 provided on the outer periphery of one end portion 50*a* of the drive shaft 50 so that the movement of the drive shaft 50 in the direction of thrust is limited by the thrust bearing 52. The other end portion 50*b* of the drive shaft 50 extends outward from the head plate 82 and this extended portion is connected to a drive source through an electromagnetic clutch or other similar means.

The rotor 60, which has a columnar shape, is provided on the drive shaft 50 in such a manner that the rotor 60 is rotatable together with the drive shaft 50 within the cylinder chamber 46. The rotor 60 is provided with e.g. four radially extending vane grooves 61 which are equidistantly spaced apart from each other in the circumferential direction. The vanes 70 are slidably received in the vane grooves 61, respectively. The base end portion of each vane groove 61 is communicated with a back-pressure chamber 62 provided inside the rotor 60 so as to extend axially thereof. Thus, each vane 70 is biased by means of the oil-hydraulic pressure within the back-pressure chamber 62 in the direction in which the vane 70 projects from the vane groove 61. The vanes 70 rotate together with the rotor 60 with their distal ends kept in sliding contact with the inner peripheral surface 41 of the cylinder chamber 46, so that an expansion chamber 71 or a compression chamber 72 is defined between the adjacent vanes 70.

The expansion chamber 71 is communicated with an intake port 47 provided in the cylinder block 40, while the compression chamber 72 is communicated with a discharge port 48 provided in the cylinder block 40. The intake port 47 and the discharge port 48 are spaced apart from each other through 180° in the circumferential direction. As the rotor 60 rotates, a refrigerant gas is drawn into the expansion chamber 71 through the intake port 47, compressed in the compression chamber 72 and then discharged from the discharge port 48.

The intake port 47 is communicated with a refrigerant gas suction bore 84 provided in the head plate 82 through a low-pressure chamber 83 defined between the head plate 82 and the front side block 20. Thus, the refrigerant gas is supplied from an air conditioner through the suction bore 84.

The discharge port 48 is communicated with a refrigerant gas discharge bore 94 provided in the casing 92 through a high-pressure chamber 93 defined inside the casing 92, so that the compressed refrigerant gas is supplied to the air conditioner through the discharge bore 94.

An oil reservoir 95 is defined by the lower portion of the high-pressure chamber 93. A communicating bore 22 provided in the front side block 20 is communicated with the oil reservoir 95, and oil is thus supplied to the bearing portion 21 through the bore 22. The oil supplied to the bearing portion 21 partially flows into a mechanical seal chamber 85 through a gap between the bearing portion 21 and the drive shaft 50 and the oil is further supplied to the cylinder chamber 46 through an oil supply bore 23 formed in the front side block 20, thus lubricating the area between the rotor 60 and each of the side blocks 20, 30 and also the sliding contact surface 41 of the cylinder block 40.

In this embodiment, the vanes 70 are formed using a relatively light-weight 20% Si-80% Al alloy material (cast material), while the rotor 60 is formed using a 12% Si-88% Al alloy material (cast material) which is lighter in weight than the alloy material for the vanes 70, and the cylinder block 40 is formed using a 16% Si-84% Al alloy material (powder extruded material). Thus, the respective silicon contents of the materials for the vanes 70, the rotor 60 and the cylinder block 40 differ from each other by more than 3%.

Setting of the silicon content difference so as to be 3% or more is based on the following finding that a silicon content difference of less than 3% may cause wear and seizure of the above-described members when in sliding contact with each other (i.e., when the compressor is in an operative state).

It is generally known that phenomena such as wear and seizure occur when two materials slide while rubbing against each other, and wear resistance and seizure resistance change in accordance with the combination of two materials that rub against each other.

The present inventor measured seizing loads in relation to various combinations of Si-Al alloy materials having different silicon contents on the basis of the Falex seizure test.

More specifically, as shown in FIG. 3, a pin 201 was produced from an aluminum alloy containing silicon, while blocks 202 and 203 each having a V-shaped groove were produced from another material than the aluminum alloy containing silicon. The pin 201 was rotated and the blocks 202 and 203 were pressed against the rotating pin 201 to measure a load at the time seizure occurred. The reference character R shown in FIG. 3 denotes the seizing load. Assuming that the angle of each V-shaped groove is 90° and the load applied to each of the blocks 202, 203 is represented by F, the seizing load P may be expressed by $P=F/2\sqrt{2}$. The limit value of the practical seizing load P is generally known to be 280 kg.

The seizure test was carried out under the following conditions:

Test conditions:
Testing machine: Falex seizure testing machine
Rotational speed of pin: 0.39 m/sec
Lubricating oil: SUNISO-5GS
(Trade mark, manufactured by Nihon Sun Sekiyu K.K.)
Oil temeprature: 80° C.
Loading: Step-up method Under these conditions, the seizure test was carried out on various pins 201 and blocks 202, 203, which had different silicon contents, with a silicon content or more set of the Si-Al alloy material differing by more than 3% or more set between each pin and the corresponding blocks. The results of the test are shown in the Table below. The terms "cast" and "extrusion" which appear in the test data in the table respectively denote a material formed by casting and a material. The balance of materials of each pin and block is all aluminum formed by powder extrusion.

TABLE (TEST RESULTS)

| Test No. | Test materials: Pin | Test materials: Blocks | Seizing load Kg |
|---|---|---|---|
| 1 | 12% Si cast | 12% Si cast | 52 |

TABLE-continued (TEST RESULTS)

| Test No. | Test materials Pin | Blocks | Seizing load Kg |
|---|---|---|---|
| 2 | 16~17% Si cast | 16~17% Si cast | 65 |
| 3 | 20% Si cast | 20% Si cast | 73 |
| 4 | 12% Si extrusion | 12% Si extrusion | 68 |
| 5 | 16~17% Si extrusion | 16~17% Si extrusion | 84 |
| 6 | 20% Si extrusion | 20% Si extrusion | 92 |
| 7 | 20% Si cast | 12% Si cast | 285 |
| 8 | 20% Si extrusion | 12% Si cast | 322 |
| 9 | 20% Si cast | 16~17% Si cast | 350 |
| 10 | 20% Si cast | 16~17% Si extrusion | 372 |
| 11 | 20% Si cast | 16~17% Si cast | 375 |
| 12 | 20% Si cast | 12% Si extrusion | 378 |
| 13 | 12% Si cast | 16~17% Si cast | 380 |
| 14 | 20% Si extrusion | 16~17% Si extrusion | 395 |
| 15 | 20% Si extrusion | 16% Si cast | 418 |
| 16 | 20% Si extrusion | 16~17% Si cast | 420 |
| 17 | 12% Si extrusion | 16~17% Si cast | 435 |
| 18 | 20% Si extrusion | 12% Si extrusion | 452 |

The results of the test shown in the table indicate that in the case where a pin and blocks, which are made from the same material, are rubbed against each other (see Test Nos. 1 to 6), the seizing load is extremely small, whereas in the case of a combination of different types of Si-Al alloy material having silicon contents which differ from each other by more than 3% or more (see Test Nos. 7 to 18), the seizing load is extremely large (i.e., the seizure resistance is high).

It may be construed from this fact that when two materials have substantially equal silicon particle diameters and substantially the same silicon particle shape, a relatively strong impact is produced between them, resulting in destruction and dissociation of the particles, and this leads to wear or seizure. On the other hand, when two materials are somewhat different in terms of the silicon particle diameter and shape, the impact is absorbed or nullified, and the silicon particle attacking force from one material acting upon the silicon particles of the other is weakened, resulting in improved resistance to wear and seizure.

In view of the above-described fact, in this embodiment the vanes 70 are formed using a 20% Si-80% Al alloy material (cast material), while the rotor 60 is formed using a 12% Si-80% Al alloy material (cast material) which is lighter in weight than the alloy material for the vanes 70, and the cylinder block 40 is formed using a 16% Si-84% Al alloy material (powder extruded material). Accordingly, the overall weight of the vane rotary compressor is reduced considerably, and yet there is no fear of the compressor suffering from problems attributable to wear or seizure even when it is used for a long period of time.

The compressor according to the present invention has the following advantages:

Since the vanes, rotor and cylinder block of the compressor are made of lightweight Si-Al alloy materials, respectively, it is possible to reduce the weight of the compressor itself. Since the Si-Al alloy materials employed to form the vanes, rotor and cylinder block of the compressor have a silicon content difference of 3% and more therebetween, it is possible to suppress the occurrence of wear and seizure at the areas of sliding contact between the rotor and the cylinder block and between the rotor and the vanes, and it is consequently possible to prevent the occurrence of troubles such as lowering of the refrigerant gas compressing capacity and failure to achieve rotor rotation. Accordingly, the compressor can be improved in terms of its capacity and durability.

As will be understood from the foregoing, the present invention is widely applicable to any means which is designed to compress a refrigerant gas and the invention is not necessarily limited to vane rotary compressors which are used only for the air conditioners of vehicles. In addition, the silicon contents of the Si-Al alloy material are not necessarily limited to those which have been mentioned in the described embodiment. The point is to employ materials having silicon contents which differ from each other by more than 3%.

What is claimed is:

1. A vane rotary compressor comprising:

a cylinder block having a cylindrical inner peripheral surface;

a front side block rigidly secured to one end of said cylinder block;

a rear side block rigidly secured to the other end of said cylinder block;

a rotor rotatably accommodated inside said cylinder block;

vanes slidably received in cane grooves, respectively, which are provided in said rotor, said vanes being projected and withdrawn in response to rotation of said rotor with their distal ends kept in sliding contact with the inner peripheral surface of said cylinder block;

said rotor and said side blocks are formed from Si-Al alloy material; and said Si-Al alloy material of said rotor and said side blocks having silicon content which differ from each other by more than 3%.

2. A vane rotary compressor comprising:

a cylinder block having a cylindrical inner peripheral surface;

a front side block rigidly secured to one end of said cylinder block;

a rear side block rigidly secured to the other end of said cylinder block;

a rotor rotatably accommodated inside said cylinder block;

vanes slidably received in vane grooves, respectively, which are provided in said rotor, said vanes being projected and withdrawn in response to rotation of said rotor with their distal ends kept in sliding contact with the inner peripheral surface of said cylinder block;

said rotor and said vanes are formed from Si-Al alloy material; and said Si-Al alloy material of said rotor and said vanes having silicon content which differ from each other by more than 3%.

* * * * *